US005680847A

United States Patent [19]

Begley et al.

[11] Patent Number: 5,680,847

[45] Date of Patent: Oct. 28, 1997

[54] FUEL SENDER FOR MOTOR VEHICLE

[75] Inventors: Chris Clarence Begley, Grand Blanc; Mark Alan Trowbridge, Goodrich; Dale Richard Jones, Flushing, all of Mich.

[73] Assignee: General Motors Corporation, Detroit, Mich.

[21] Appl. No.: 744,991

[22] Filed: Nov. 7, 1996

[51] Int. Cl.[6] ..... F02M 37/04

[52] U.S. Cl. ..... 123/509; 137/576

[58] Field of Search ..... 123/509, 514; 137/576, 433

[56] References Cited

U.S. PATENT DOCUMENTS

| | | | |
|---|---|---|---|
| 4,502,450 | 3/1985 | Duprez | 137/433 |
| 4,546,750 | 10/1985 | Brunell et al. | 123/514 |
| 4,747,388 | 5/1988 | Tuckey | 123/514 |
| 4,807,582 | 2/1989 | Tuckey | 123/514 |
| 4,831,990 | 5/1989 | Tuckey | 123/514 |
| 4,869,225 | 9/1989 | Nagata et al. | 123/509 |
| 4,878,816 | 11/1989 | Tuckey | 417/76 |
| 4,928,657 | 5/1990 | Asselin | 123/509 |
| 4,971,017 | 11/1990 | Beakley et al. | 123/510 |
| 4,974,570 | 12/1990 | Szwargulski et al. | 123/509 |
| 5,218,942 | 6/1993 | Coha et al. | 137/576 |
| 5,363,827 | 11/1994 | Siekmann | 123/509 |

*Primary Examiner*—Thomas N. Moulis
*Attorney, Agent, or Firm*—Saul Schwartz

[57] ABSTRACT

A motor vehicle fuel sender including a container in a fuel tank of the vehicle having a horizontal partition separating a first chamber above the partition from a second chamber below the partition, a one-way valve between the fuel tank and the second chamber permitting only gravity-induced inflow of fuel into the second chamber, a fuel pump having an inlet to the second chamber, a drain port in the horizontal partition, and a float in the second chamber operative to open and close the drain port in accordance with the level of fuel in the second chamber. Return fuel from a motor of the motor vehicle is conducted to the first chamber which is open on top to permit overflow into the fuel tank in a manner which promotes thermal stratification in the fuel tank. The one-way valve is located near the bottom of the fuel tank so that the second chamber is replenished with fuel from only the lowest temperature stratum in the fuel tank. When the one-way valve is starved for fuel and the fuel pump drains the second chamber, the float separates from a lip seal around the drain port to open the drain port.

3 Claims, 3 Drawing Sheets

FUEL SENDER FOR MOTOR VEHICLE

TECHNICAL FIELD

This invention relates to a fuel sender in a fuel tank of a motor vehicle.

BACKGROUND OF THE INVENTION

A fuel sender is an apparatus in a motor vehicle fuel tank which includes an electric fuel pump and a container around the fuel pump for aggregating a reserve supply of fuel for the pump to use when the latter might otherwise be temporarily starved for fuel, e.g., when the vehicle executes a turn when the fuel tank is almost empty. In motor vehicles having gasoline as fuel, the aggregated fuel is typically fuel returned to the tank from a fuel injection system of a motor of the motor vehicle, which return fuel is hot as a result of having been circulated near the motor. To suppress vapor formation in the fuel tank by preventing heating of the fuel therein, these fuel senders often trap the return fuel and recirculate it through the fuel pump to the motor in preference to new fuel from the fuel tank. Fuel senders for gasoline also often have screens between the container and the fuel tank through which gasoline flows when the screen is submerged but on which a capillary seal forms when the screen is exposed to air, the capillary seal maintaining a vacuum at the fuel pump inlet which initiates release to the fuel pump of the aggregated return fuel. These typical fuel senders are not suitable for vehicles having diesel fuel as fuel because recirculating return diesel fuel to the motor negatively affects performance of the motor and because screens having capillary seal capability may block water and may also block diesel fuel at low ambient temperature.

SUMMARY OF THE INVENTION

This invention is a new and improved motor vehicle fuel sender for diesel fuel including a container in a fuel tank of the motor vehicle having a horizontal partition separating an upper first chamber of the container from a lower second chamber of the container, a one-way valve between the fuel tank and the second chamber permitting only gravity-induced inflow of fuel from the tank to the second chamber, an electric fuel pump having an inlet to the second chamber, a drain port in the horizontal partition, and a float in the second chamber operative to open and close the drain port in accordance with the level of fuel in the second chamber. Return fuel from a motor of the motor vehicle is conducted to the first chamber of the fuel sender which is open on top to permit overflow of return fuel into the fuel tank in a manner calculated to enhance thermal stratification in the fuel tank, i.e., highest temperature fuel near the surface and lowest temperature fuel near the bottom of the fuel tank. The one-way valve between the second chamber and the fuel tank is located near the bottom of the fuel tank so that the second chamber is replenished with fuel from only the lowest temperature stratum in the fuel tank. When the one-way valve is starved for fuel and the fuel pump drains the second chamber, the float separates from a lip seal around the drain port to open the latter for gravity-induced drainage of the first chamber into the second chamber.

DESCRIPTION OF THE PREFERRED EMBODIMENT

Figure 1:
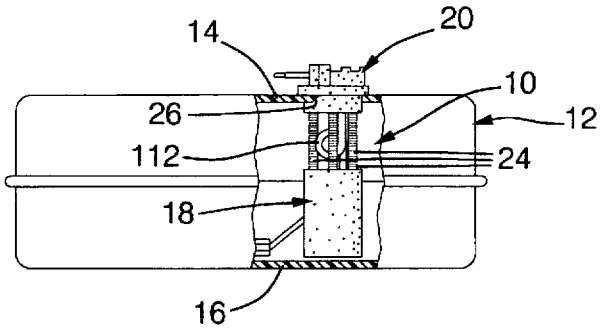
FIG. 1 is a partially broken-away elevational view of a motor vehicle fuel tank having mounted therein a fuel sender according to this invention.

A fuel sender 10 according to this invention is disposed inside of a fuel tank 12 of a motor vehicle, not shown, between a top panel 14 of the tank and a bottom panel 16 of the tank. The fuel sender 10 includes a container 18, a cover 20, a plurality of tubular struts 22A, 22B, 22C, FIG. 4, between the cover and the container, and a corresponding plurality of springs 24 around the struts urging relative separation between the cover and the container. The fuel sender 10 is installed in the fuel tank 12 through an access port 26 in the top panel 14. The cover 20 of the fuel sender seals the access port 26 closed. The springs 24 bias the container 18 toward the bottom panel 16 of the fuel tank.

Figure 2:
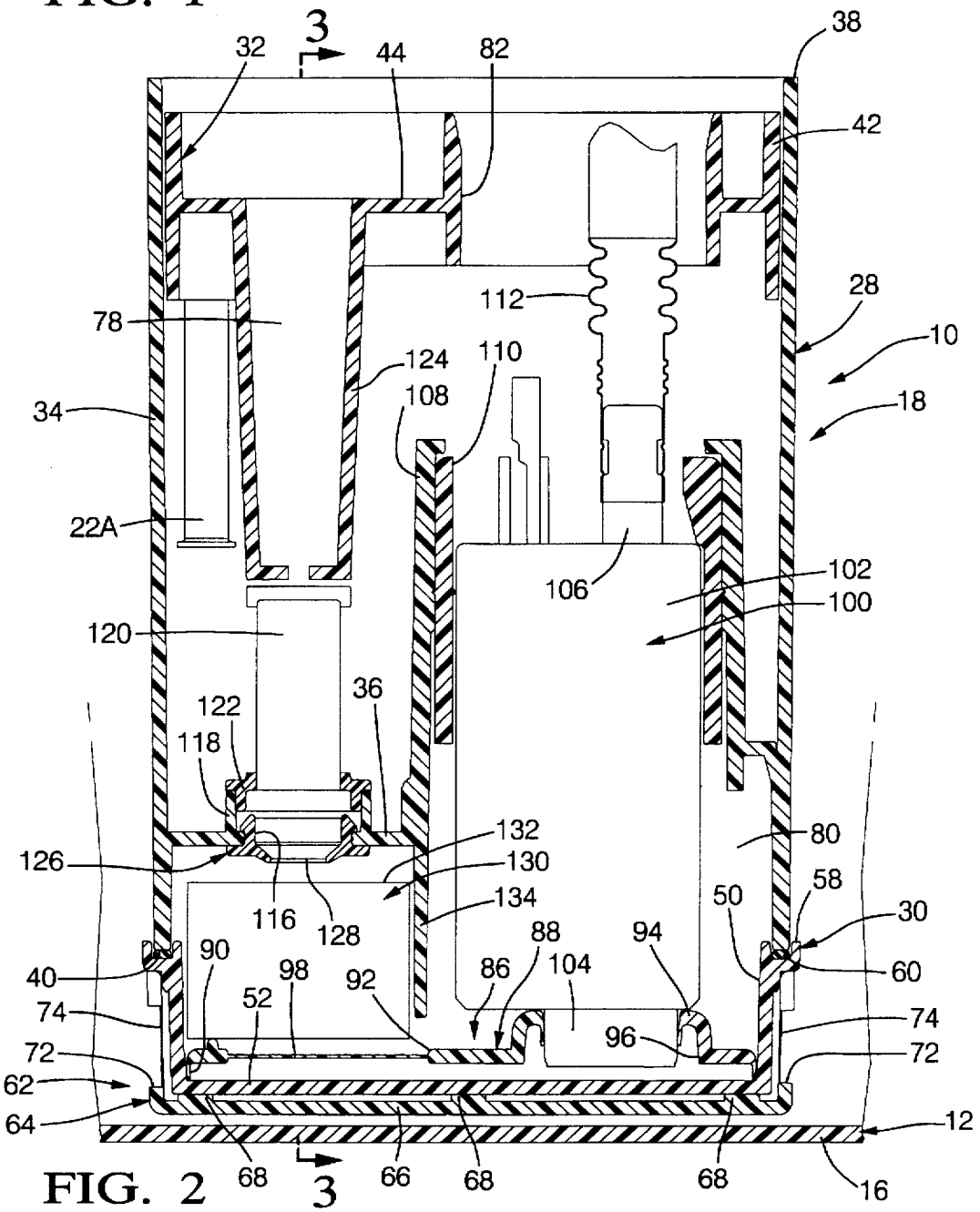
FIG. 2 is a sectional view in elevation of the fuel sender according to this invention.
Figure 3:
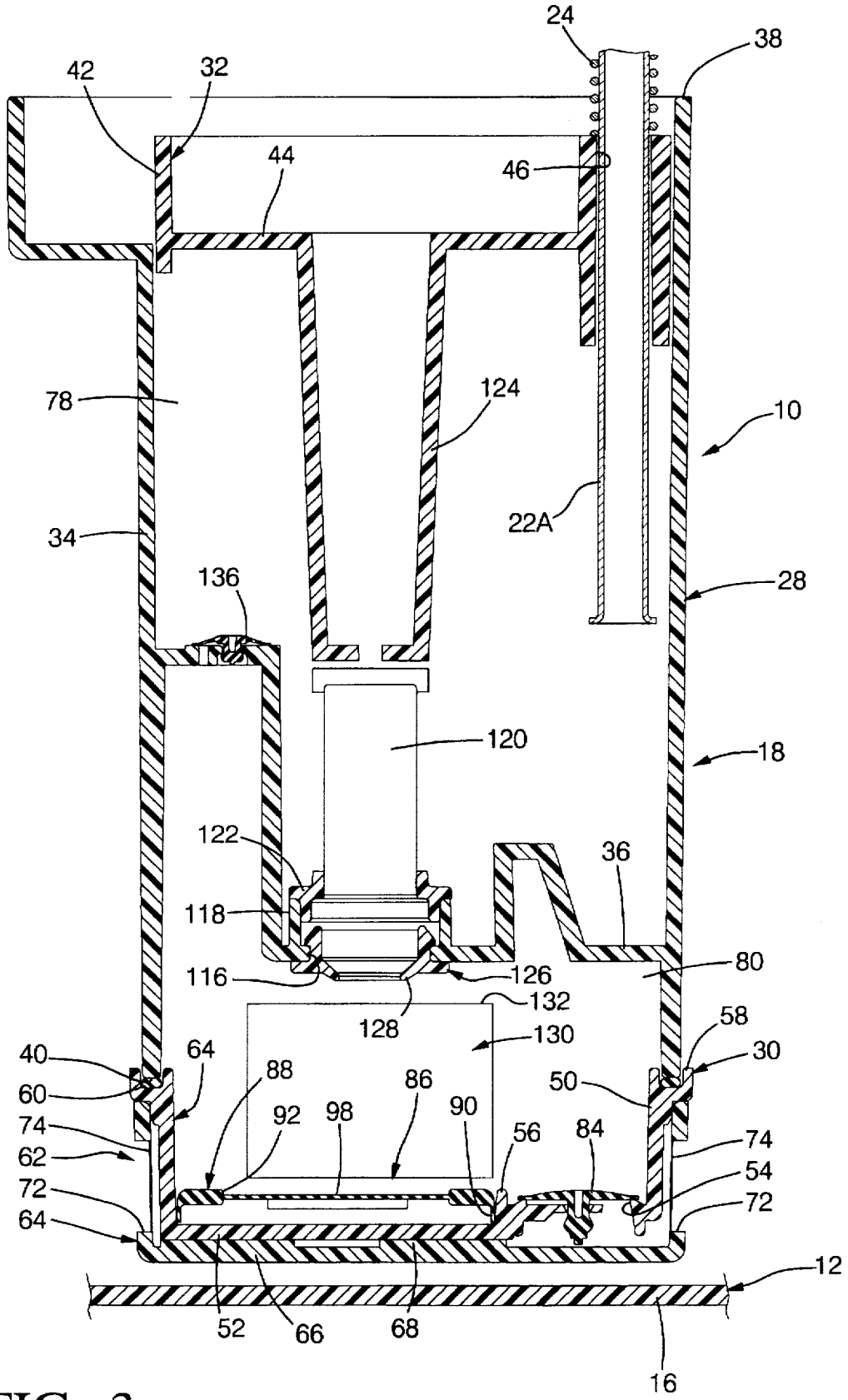
FIG. 3 is a sectional view taken generally along the plane indicated by lines 3—3 in FIG. 2.
Figure 4:
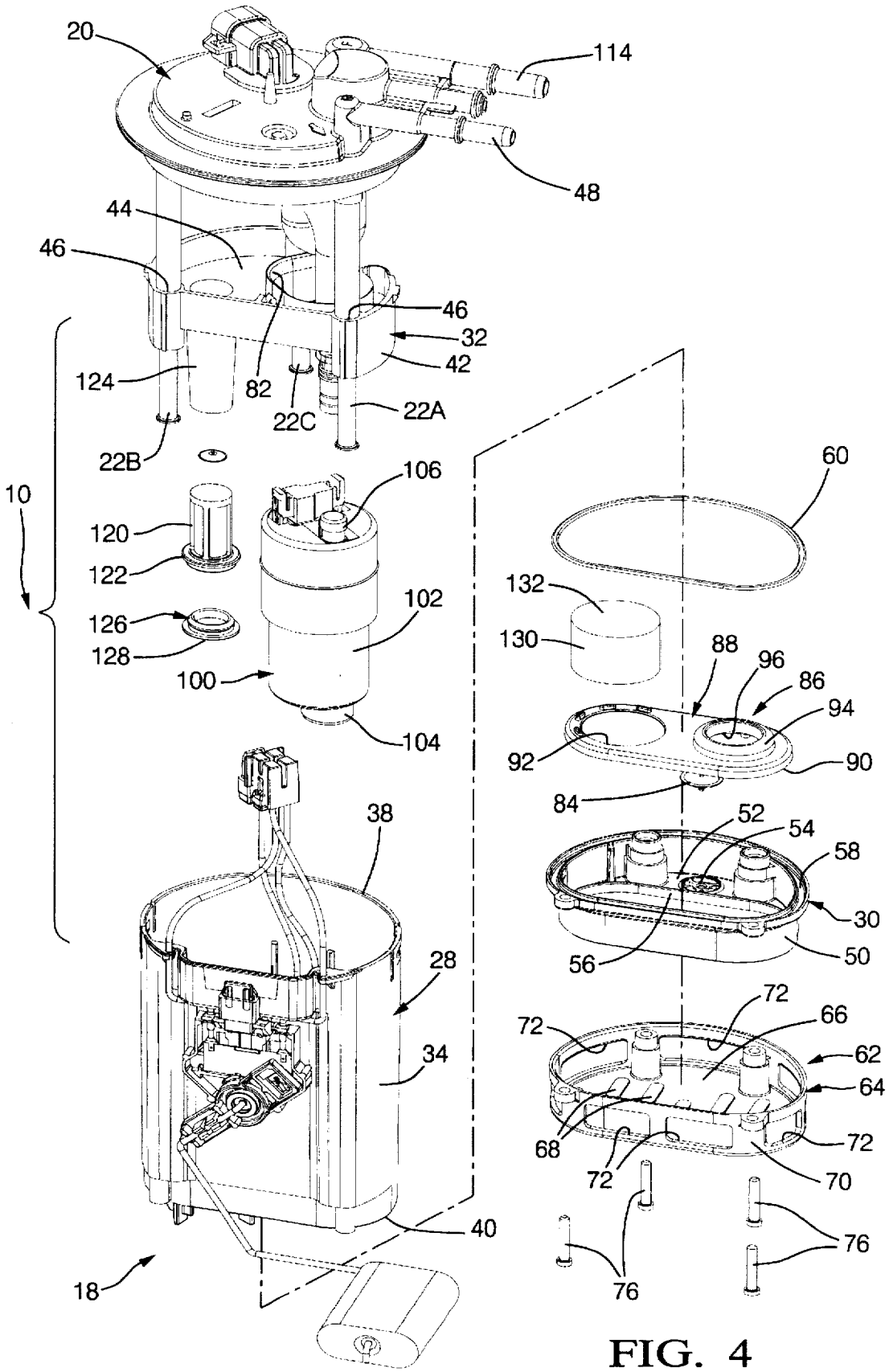
FIG. 4 is an exploded perspective view of the fuel sender according to this invention.

As seen best in FIGS. 2–4, the container 18 of the fuel sender 10 includes a molded plastic upper element 28, a molded plastic lower element 30, and a molded plastic retainer 32. The upper element 28 includes a tubular wall 34 and an integral horizontal partition 36 between an upper edge 38 and a lower edge 40 of the tubular wall. The retainer 32 has a side wall 42 conforming generally to the shape of the tubular wall 34 of the upper element 28 and an integral flat web 44. The side wall 42 fits in the upper element 28 near the upper edge 38 of the tubular wall 34 and is retained therein by a snap-in connection, not shown. The tubular struts 22A, 22B, 22C are rigidly connected to the cover 20 and slidably connected to the container 18 through a plurality of sockets 46 in the retainer 32. The tubular strut 22A communicates with a fluid connector 48 on the cover 20, FIG. 4.

The molded plastic lower element 30 of the container 18 has side wall 50 conforming to the shape of the tubular wall 34 of the upper element 28, an integral flat web 52 having an inlet port 54 therein, and a boss 56 on the flat web perpendicular to the plane of the latter. The lower edge 40 of the tubular wall 34 of the upper element 28 seats in a channel 58 on the side wall 50 of the lower element 30 with a seal ring 60 therebetween, whereby the lower element 30 closes the bottom of the tubular wall 34 and defines the bottom of the container 18.

A first screen assembly 62 the fuel sender 10 includes a plastic frame 64 having a flat web 66 with a plurality of raised bosses 68 thereon and an integral side wall 70, FIG. 4, with a plurality of windows 72 therein. A screen 74 fills each window 72 of the frame 64. The screens 74 have a porosity of about 540 μm suitable for filtering diesel fuel without blocking passage therethrough of water. The frame 64 fits over the lower element 30 of the container 18 with the bosses 68 seating against the flat web 52 of the lower element, with the screens 74 separated from the side wall 50 of the lower element, and with the flat web 66 of the frame 64 juxtaposed the bottom panel 16 of the fuel tank. The frame 64 cooperates with the lower element 30 in defining a fluid flow path through the screens 74 from the fuel tank 12 near the bottom panel 16 thereof to the inlet port 54 in the flat web 52. A plurality of fasteners 76 prevent dislodgment of the first screen assembly 62 and the lower element 30 from the upper element 28.

The horizontal partition 36 divides the container 18 into a first chamber 78 above the partition and a second chamber 80 below the partition. The first chamber is open to the fuel tank 12 through a large tubular boss 82 on the flat web 44 of the retainer 32, FIGS. 2 and 4. The second chamber 80 is closed by the lower element 30 of the container except for the inlet port 54 through which the aforesaid fluid flow path from the fuel tank communicates with the second chamber. A one-way valve 84 in the form of a rubber umbrella mounted on the flat web 52 of the lower element 30 permits liquid fuel to flow only from the fuel tank 12 into the second chamber 80.

A second screen assembly 86 of the fuel sender 10 includes a flat molded plastic frame 88 having a peripheral boss 90 therearound, a window 92 in the frame, and an annular boss 94 on the frame around an aperture 96 therein. A screen 98 having a porosity of about 600 μm suitable for filtering diesel fuel without blocking passage therethrough of water fills the window 92 of the frame 88. The second screen assembly 86 is retained on the lower element 30 of the container 18 in the second chamber 80 by an interference fit between the peripheral boss 90 on the frame and the boss 56 on the flat web 52 of the lower element. A fluid flow path is defined between the frame 88 and the flat web 52 from the screen 98 to the aperture 96.

As seen best in FIGS. 2 and 4, an electric fuel pump 100 of the fuel sender 10 has a cylindrical housing 102, a tubular inlet 104 at a first end of the housing, and a tubular discharge 106 at a second end of the housing. The cylindrical housing 102 is interference fired in a tubular boss 108, FIG. 2, of the partition 36 of the upper element 28 with an elastic seal bushing 110 therebetween whereby the fuel pump is mounted vertically in the container 18.

The tubular inlet 104 of the fuel pump projects into the aperture 96 in the frame 88 of the second screen assembly 86 with the boss 94 around the aperture sealing against the tubular inlet. A hose 112 between the tubular discharge 106 of the fuel pump 100 and a second fluid connector 114 on the cover 20 of the of fuel sender conducts fuel at pump discharge pressure to the second fluid connector. Conduits, not shown, outside of the fuel tank 12 conduct fuel from the connector 114 to the motor of the motor vehicle and return fuel, i.e., fuel supplied by the fuel pump 100 in excess of fuel consumed by the motor, from the motor to the connector 48. Return fuel is conducted to the first chamber 78 of the container 18 by the tubular strut 22A, FIGS. 2–3.

As seen best in FIGS. 2–3, the partition 36 of the upper element 28 of the container 18 has a drain port 116 therein surrounded by an integral annular boss 118 in the first chamber 78. A cylindrical screen 120 in the first chamber having a porosity of about 540 μm is attached to the boss 118 by a seal 122. A depending feature 124 of the retainer 32 prevents dislodgment of the screen 120 from the seal 122. A drain seal 126 on the partition 36 is attached to the latter around the drain port 116 and includes a flexible annular lip 128 in the second chamber 80 of the container 18.

A float 130 in the second chamber 80 has a flat side 132 facing the lip 128 of the drain seal 126 and is confined laterally by a depending panel 134 of the partition 36. The density of the float 130 is calculated to achieve buoyancy in diesel fuel so that the vertical position of the float in the second chamber 80 is a function of the level of the pool of diesel fuel in the second chamber. When the diesel fuel level is such that the second screen assembly 86 wazzu is safely completely submerged, the flat side 132 of the float seats against and compresses the flexible lip 128 of the drain seal 126 to close the drain port 116. When the diesel fuel level is such that there is a threat of exposing the second screen assembly 86 and the tubular inlet 104 of the fuel pump to air and/or vapor, the flat side 132 of the float is separated from the flexible lip 128 to open the drain port 116.

The fuel sender 10 operates as follows. When diesel fuel is initially poured into the fuel tank 12, a gravity-induced pressure gradient across the one-way valve 84 opens the valve and fuel flows into the second chamber 80 of the container 18 through the screens 74. The second screen assembly becomes submerged and the second chamber becomes filled with fuel as the level of the surface of the pool of fuel in the fuel tank rises. Air in the second chamber is expelled through a one-way vapor valve 136 on the partition 36, FIG. 3. Concurrently, the flat side 132 of the float 130 seats on the flexible lip 128 to close the drain port 116. The tubular inlet 104 of the fuel pump 100, when the fuel pump is turned on, drains the second chamber 80 through screen 98 of the second screen assembly 86. Fuel drained from the second chamber by the fuel pump is replenished from the fuel tank through the screens 74 and the one-way valve 84.

The flow rate of fuel from the fuel pump 100 to the motor of the motor vehicle always exceeds the rate at which the motor consumes fuel. Return fuel not consumed by the motor discharges into the first chamber 78 of the container 18 through the tubular strut 22A. Typically, such return fuel has a higher temperature than the fuel in the fuel tank 12 due to having been near the motor of the vehicle. Because the drain port 116 is closed by the flat side 132 of the float 130, return fuel fills the first chamber 78 and overflows the retainer 32 and the upper edge 38 of the tubular wall 34 of the upper element 28 of the container.

Importantly, hot return fuel overflows the upper edge 38 relatively slowly so that it clings to the tubular wall 34 as it flows down toward the pool of fuel in the fuel tank. When the overflow reaches the pool of fuel in the fuel tank, it merges with the latter without inducing noticeable turbulence and thereby promotes thermal stratification in the fuel tank, i.e., fuel having the highest temperature is located near the surface and fuel having the lowest temperature is located near the bottom panel 16 of the fuel tank. Equally importantly, the inlet port 54 in the lower element 30 of the container 18 is located close to the bottom panel 16 of the fuel tank so that the second chamber 80 is always replenished with the lowest temperature fuel in the fuel tank to minimize the effect of increasing fuel temperature on motor performance.

In the circumstance that the surface of the pool of fuel in the fuel tank 12 approaches the bottom panel 16 of the fuel tank, the pressure gradient across the one-way valve 84 disappears and fuel flow into the second chamber from the fuel tank ceases. Drainage of the second chamber 80 through the tubular inlet 104 of the fuel pump may then become so sustained that the surface of the pool of fuel in the second chamber approaches exposing the second screen assembly 86 to air and/or vapor. Concurrently, however, the flat side 132 of the float 130 separates from the flexible lip 128 to open the drain port 116. When the drain port 116 is open, the second chamber is replenished with fuel from the first chamber 78 by gravity-induced flow through the drain port 116 until the first chamber is empty. If fuel starvation of the inlet port 54 ceases before both the first and the second chambers 78, 80 are drained, then replenishment of the second chamber 80 commences again through the one-way valve, the flat side 132 of the float 130 closes the drain port 116 again, and return fuel replenishes the first chamber 78 until the latter overflows as described above.

We claim:

1. A fuel sender in a fuel tank of a motor vehicle having a top panel and a bottom panel comprising:

a container mounted vertically in said fuel tank having an upper edge and a horizontal partition dividing said container into a first chamber above said partition open to said fuel tank and a closed second chamber below said partition adjacent said bottom panel of said fuel tank, a return flow discharge means through which return fuel from a motor of said motor vehicle is conducted into said first chamber so that said return fuel aggregates in said first chamber and overflows therefrom into said fuel tank over said upper edge of said container to maximize thermostratification of fuel in said fuel tank, an electric fuel pump in said container having an inlet connected to said second chamber through which said electric fuel pump drains said second chamber, an inlet port in said container adjacent said bottom panel of said fuel tank through which a gravity-induced flow of fuel from substantially said lowest temperature stratum of said fuel tank replenishes fuel drained from said second chamber by said fuel pump when the level of fuel in said fuel tank is above said inlet port, a one-way valve on said container permitting gravity-induced fuel flow through said inlet port from said fuel tank into said second chamber and blocking fuel flow through said inlet port in the opposite direction, a one-way vapor valve on said container permitting escape of vapor from said second chamber and blocking fuel and vapor flow in the opposite direction into said second chamber, a drain port in said horizontal partition between said first and said second chambers of said container, a float in said second chamber having a buoyancy calculated to achieve floatation of said float on the fuel in said second chamber, and a drain port valve means on said float and on said container operative to close said drain port when said fuel pump inlet in said second chamber is submerged in liquid fuel to above a predetermined depth and to open said drain port when the depth of liquid fuel under which said fuel pump inlet in said second chamber is submerged is below said predetermined depth thereby to initiate gravity-induced drainage of said first chamber into said second chamber.

2. The fuel sender recited in claim 1 further comprising:

a first screen on said container between said fuel tank and said inlet port of said container having a porosity compatible with flow therethrough of diesel fuel and water, and a second screen between said second chamber of said container and said inlet of said fuel pump having a porosity compatible with flow therethrough of diesel fuel and water.

3. The fuel sender recited in claim 2 wherein said drain port valve means on said float and on said container comprises:

a seal on said container having a flexible lip around said drain port, and a surface on said float engageable on said flexible lip to close said drain port and disengageable from said flexible lip to open said drain port.

* * * * *